US005996733A

United States Patent [19]

DeTuncq et al.

[11] Patent Number: 5,996,733

[45] Date of Patent: Dec. 7, 1999

[54] DUAL FREQUENCY SIDE BRANCH RESONATOR

[75] Inventors: Jon A. DeTuncq, Richfield; Steven M. Gleason, Golden Valley, both of Minn.

[73] Assignee: Thermo King Corporation, Minneapolis, Miss.

[21] Appl. No.: 09/197,630

[22] Filed: Nov. 20, 1998

[51] Int. Cl.[6] ..... F01N 1/02

[52] U.S. Cl. ..... 181/250; 181/255; 181/273; 181/276

[58] Field of Search ..... 181/224, 226, 181/227, 228, 229, 232, 236, 241, 243, 246, 250, 253, 255, 273, 276

[56] References Cited

U.S. PATENT DOCUMENTS

| | | | |
|---|---|---|---|
| 2,027,359 | 1/1936 | Wood et al. . | |
| 2,297,046 | 9/1942 | Bourne . | |
| 2,297,530 | 9/1942 | Blanchard . | |
| 3,396,812 | 8/1968 | Wilcox et al. . | |
| 4,501,341 | 2/1985 | Jones . | |
| 4,800,985 | 1/1989 | Hanzawa et al. . | |
| 5,096,010 | 3/1992 | Ojala et al. . | |
| 5,317,112 | 5/1994 | Lee . | |
| 5,349,141 | 9/1994 | Horibe et al. | 181/224 |

FOREIGN PATENT DOCUMENTS

| | | |
|---|---|---|
| 546988 | 8/1956 | Italy . |
| 61-190159 | 8/1986 | Japan . |
| 6-159175 | 6/1994 | Japan . |

OTHER PUBLICATIONS

Thermo King Brochure, Whisper Edition, TK50118 (Oct. 1997).

*Primary Examiner*—Khanh Dang
*Attorney, Agent, or Firm*—Michael M. Gnibus

[57] ABSTRACT

A side branch resonator for attenuating sound waves of first and second frequencies, the side branch resonator comprising a discharge branch; a resonator branch; an inlet branch flow connected to the discharge branch having an axis, the resonator branch having a wall which defines a resonator branch interior; the resonator branch having an open resonator branch end and a closed resonator branch end; the resonator further comprising an attenuation member for attenuating the first frequency sound waves. The attenuation member is located in the resonator branch interior a first distance from the axis and upstream from the resonator branch closed end. The closed resonator branch end is located a second distance from the axis to provide attenuation of the second frequency sound waves.

19 Claims, 3 Drawing Sheets

DUAL FREQUENCY SIDE BRANCH RESONATOR

BACKGROUND OF THE INVENTION

The invention relates to a resonator; and more particularly the invention relates to a unitary dual frequency side branch resonator having an inlet branch, a discharge branch, and a resonator branch with attenuating means for attenuating sound waves at a first frequency located in the resonator branch and a resonator branch closed end downstream of the attenuating means for attenuating sound waves at a second frequency.

Mobile temperature control units are typically mounted on the end of a trailer behind the cab. The units can be quite noisy approaching sound levels of 80 dB and the loud units make it difficult for the driver to sleep while the unit is running, and furthermore while driving, the emitted noise can be a source of driver discomfort on long hauling trips. The relatively low driver retention rate in the trucking industry is in large part attributed to relatively high noise emission levels of refrigeration units. Additionally, the relatively loud units introduce considerable noise into the "community" when the units are being unloaded at loading docks, grocery stores, distribution centers or dairies; or when the associated trucks are parked at motels or hotels.

Much of the noise produced by a refrigeration unit is generated by the refrigeration unit's prime mover which is typically a diesel engine. The diesel engine drives a compressor which compresses a conventional refrigerant during a well known conventional refrigeration cycle. A large portion of the diesel engine noise is generated during the combustion process. A portion of the combustion noise produced by the diesel engine flows unabated upstream and out the diesel engine air intake manifold.

Frequently an air cleaner is flow connected to the intake manifold and the air cleaner serves to attenuate the higher frequency wave components of the engine noise. As a result, the resultant filtered engine noise is comprised mainly of low frequency noise. The resultant low frequency noise is at a frequency that is too low to be attenuated by common techniques and methods such as acoustical foam.

Known conventional apparatus for attenuating multiple frequency sound waves are typically expensive and complex and are comprised of multiple component parts such as valves or flappers. Others require separate branches for each frequency sound wave attenuated. Such known devices for attenuating multiple frequencies are bulky and do not easily fit in the limited space of a refrigeration unit.

The foregoing illustrates limitations known to exist in present devices and methods. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a side branch resonator for attenuating sound waves of at least two frequencies, in broadest terms the resonator comprises a unitary resonator body having a discharge branch with an open end; a resonator branch having a resonator branch open end and a closed end and defining a resonator branch interior; an inlet branch having an axis; the side branch resonator further comprising attenuating means for attenuating sound waves at a first frequency, the attenuating means is located in the resonator branch interior a first distance from the third branch axis, the closed end is located a second distance from the inlet branch axis to attenuate sound waves at a second frequency. The resonator branch is comprised of a single tube resonator.

Known single tube resonators only attenuate noise at a single frequency. Additional benefits of the resonator of the present invention include a unitary resonator body which permits the resonator to more easily meet the limited space requirements of existing refrigeration systems. The resonator attenuating means is comprised of a disk with a centrally located circular opening in the disk that permits sound waves at the second frequency to pass therethrough. The disk body attenuates sound waves at the first frequency. The attenuating means is located away from the inlet branch axis a first distance equal to one quarter the wavelength of the first frequency sound waves. The closed end is located away from the inlet branch axis a distance equal to one quarter the wavelength of the second frequency sound waves.

The foregoing and other aspects will become apparent from the following detailed description of the invention when considered in conjunction with the accompanying drawing figures.

DESCRIPTION OF THE DRAWING FIGURES

DESCRIPTION OF THE PREFERRED EMBODIMENT

Figures 1, 2:
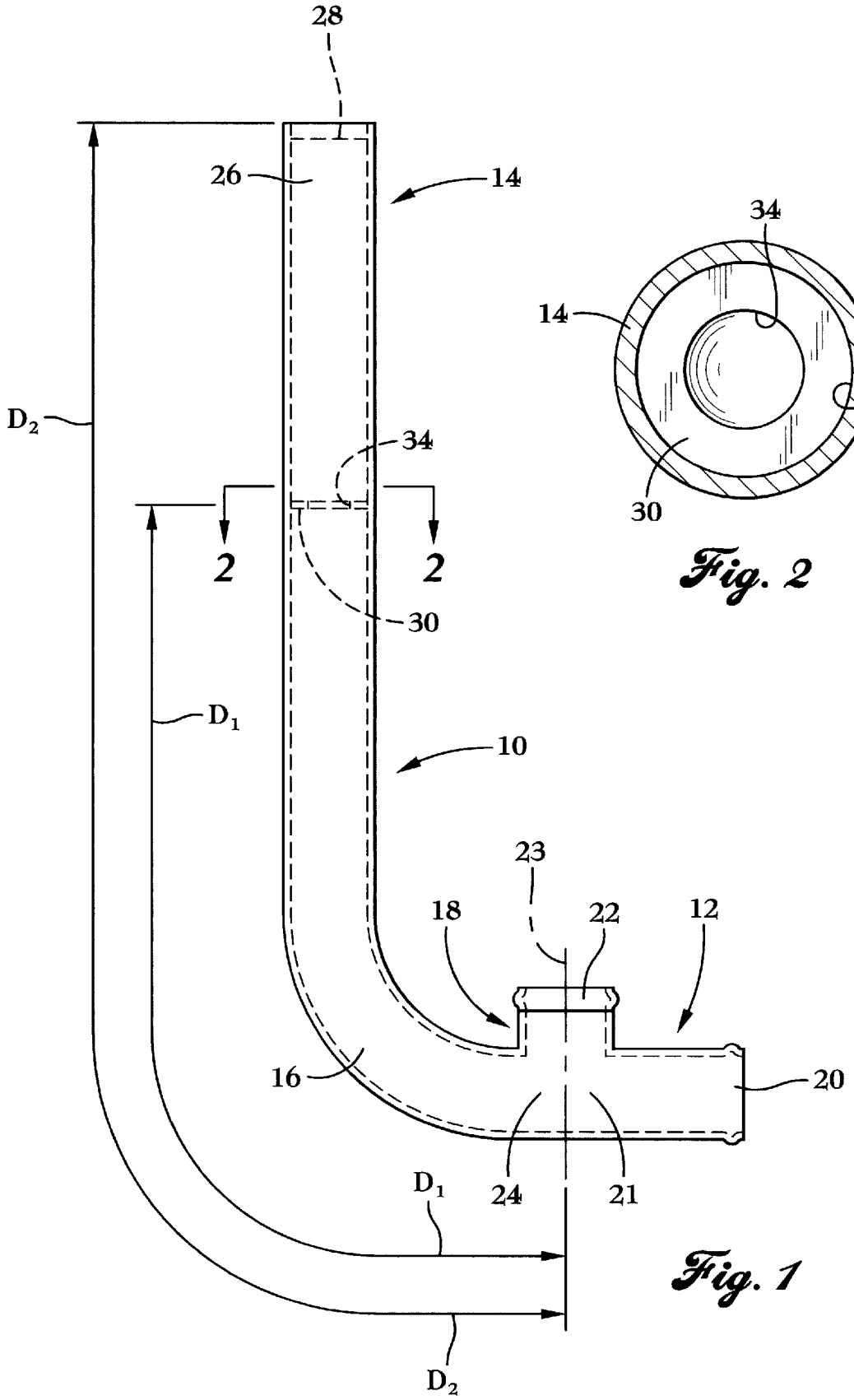
FIG. 1 is a front view of the resonator of the present invention.
FIG. 2 is a sectional view taken along line 2—2 of FIG. 1.

Turning now to the drawings wherein like parts are referred to by the same number throughout the several views, and particularly FIG. 1, which illustrates resonator 10 of the present invention, the resonator 10 is unitary and includes discharge, and resonator tubular branches 12 and 14. The resonator branch includes an elbow or turn portion 16 which serves to offset the downstream or attenuating portion of the resonator branch from the upstream portion of the second branch by approximately ninety degrees as illustrated in FIG. 1.

A tubular inlet resonator branch 18 is located along the exterior of the resonator body where the discharge and resonator branches 12 and 14 are flow connected. As illustrated in FIG. 1, the inlet resonator branch has a central axis 23. Ambient air is supplied to the prime mover 10 through inlet branch inlet 22.

The discharge branch 12 has an open discharge end 20, inlet end 21 and resonator branch 14 has an open first inlet end 24 and a closed second end 26. The second end 26 is closed by a cap 28 which may be threadably connected to the resonator branch or connected by other suitable conventional means such as a weld connection for example. The tubular walls of the discharge, resonator, and inlet branches define resonator interior 32.

Attenuating means 30 is located away in the portion of the resonator interior 32 defined by the resonator branch. See FIGS. 1 and 2. The attenuating means 30 is disk shaped and includes an aperture 34 formed in the center of the disk shaped body. Although a single centered circular aperture is shown in FIG. 2, it is contemplated that attenuating means aperture 34 may be comprised of a single aperture having a non-circular shape or a plurality of circular and non-circular apertures spaced along the means 30. In addition to the described disk shaped body, the attenuating means body may be rectangular-shaped or have any other shape that permits the attenuating means to be located in the resonator branch to attenuate sound waves of a first frequency.

The attenuating means 30 is located a first distance from the central axis 23, and this first distance is identified in FIG. 1 as $D_1$. The end cap 28 is located a second distance from central axis 23, and this second distance is identified in FIG. 1 as $D_2$. The first distance is equal to one quarter of the wave length of prime mover noise at a first frequency, and the second distance is equal to one quarter of the wave length of prime mover noise at a second frequency. Also the attenuating means 30 is located at a nodal point for the first frequency wave, and the closed end cap is located at a nodal point for the second frequency wave.

Figure 3:
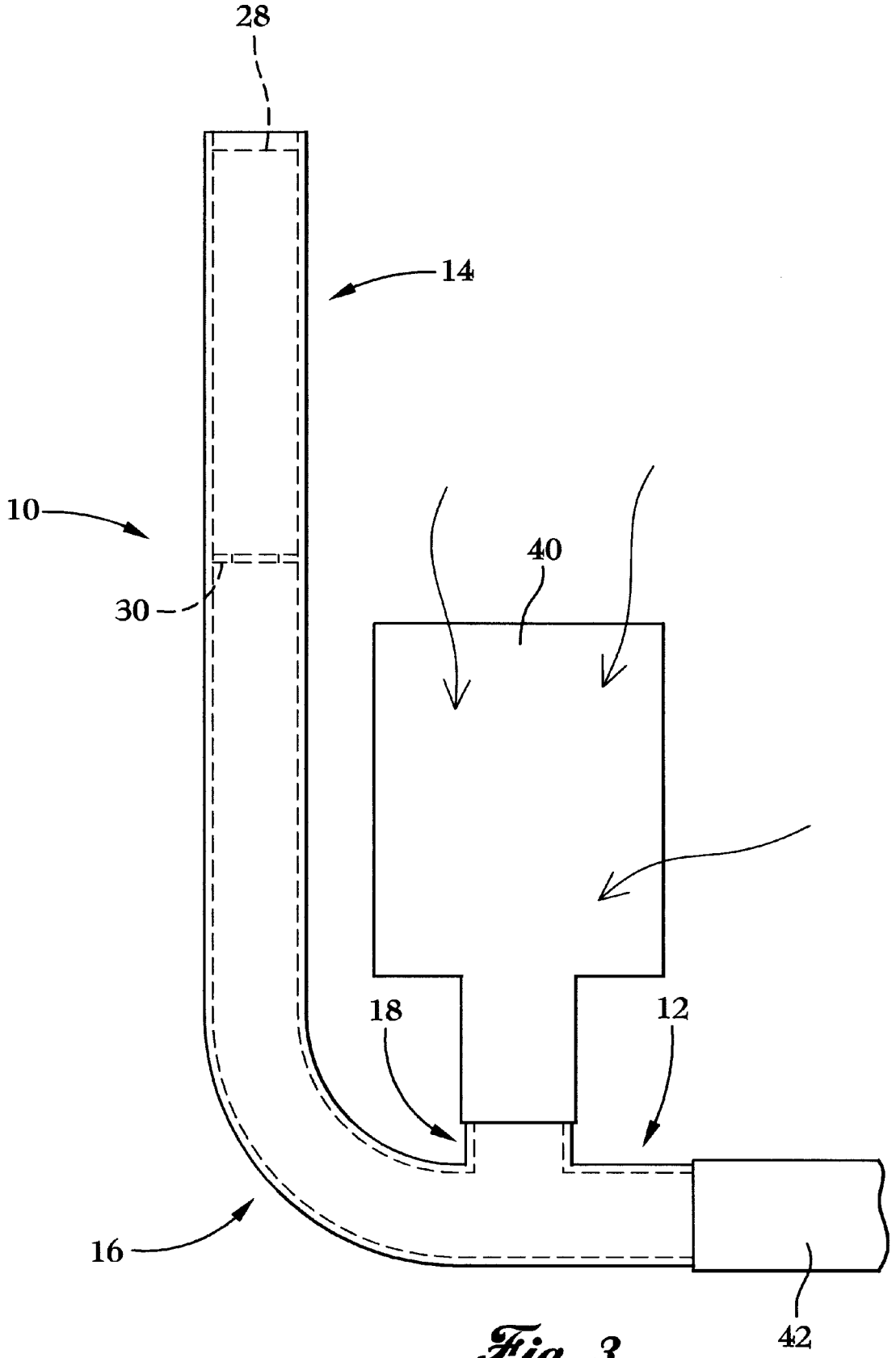
FIG. 3 is a front view of the resonator similar to FIG. 1 with an inlet air filter and discharge flow member flow connected to the resonator.
Figure 4:
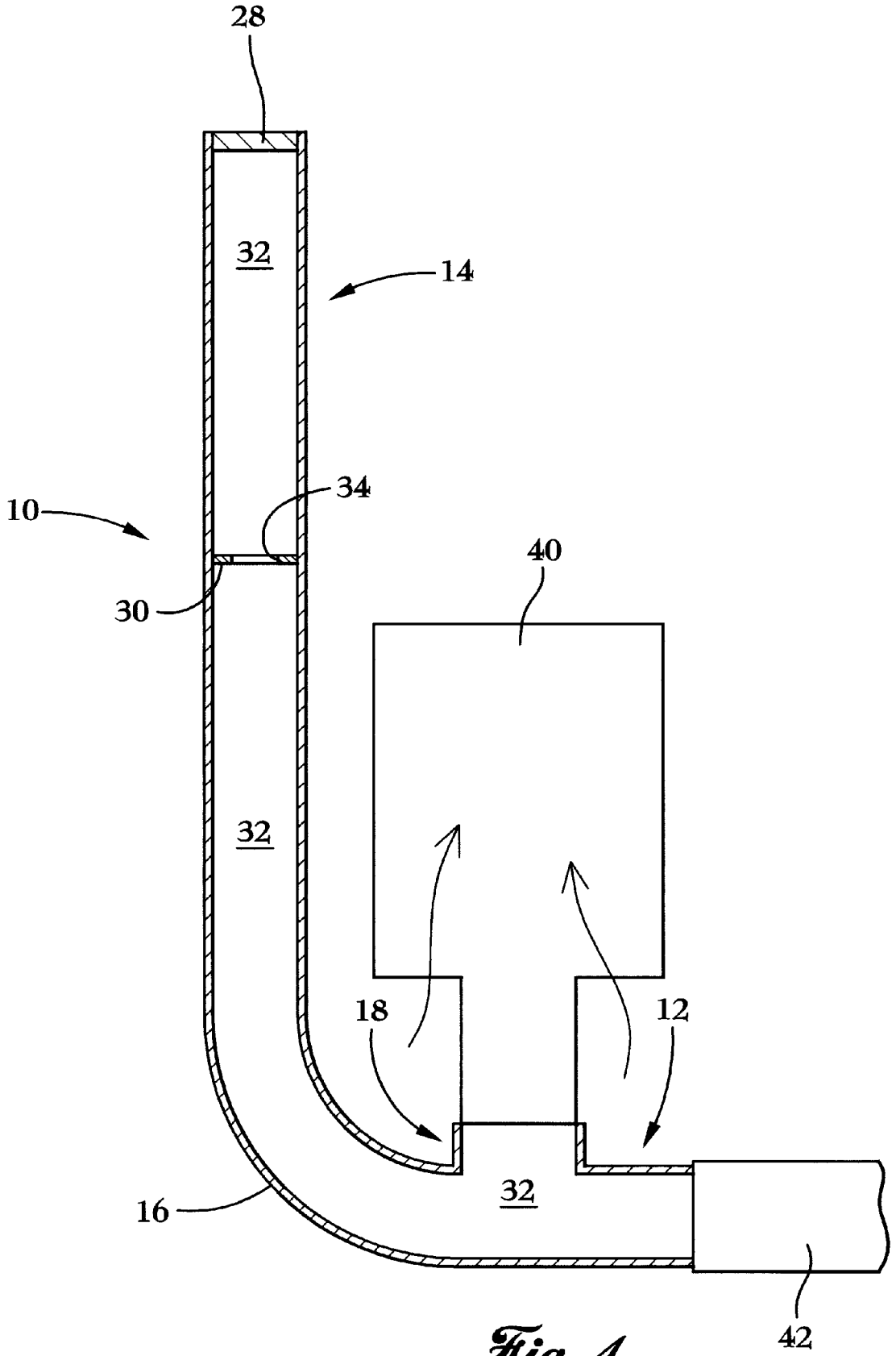
FIG. 4 is a longitudinal sectional view of the resonator illustrated in FIG. 3 with a segment of a first frequency sound wave provided to illustrate the attenuation of the first frequency sound waves by the resonator attenuating means.

As shown in FIG. 3, a conventional air cleaner 40 is flow connected to the inlet branch 18 at the inlet branch open end 22. During operation of the refrigeration prime mover, an inlet fluid such as ambient air is drawn through the cleaner 40 into the inlet branch 18, continues through discharge branch 12 and into prime mover intake manifold 42 that is flow connected to discharge branch 12. The intake manifold may be directly flow connected to the discharge branch as illustrated in FIG. 3 or may be connected by an intermediate conduit connected to discharge branch 12 and manifold 42.

The operation of resonator 10 will now be described. During operation of the prime mover (not shown) noise produced during the prime mover combustion cycle propagates from the combustion chamber of the prime mover through intake manifold 42 and into the resonator 10. The prime mover noise is comprised of a complex waveform consisting of two or more sinusoids or frequencies. For purposes of describing the preferred embodiment of the invention, the prime mover combustion noise is substantially comprised of a first frequency noise component with a first frequency of 219 Hz and a second frequency noise component with a frequency of 146 Hz. In the present invention the prime mover is a diesel engine that operates at a high speed and a low speed. Based on experimentation, it was determined by the inventors that the second frequency noise component is equal to the second multiple of the firing frequency of the prime mover diesel engine at high speed and the third multiple of the firing frequency of the diesel engine at low speed. The first frequency noise component is equal to the third multiple of the engine high speed firing frequency. The distance $D_1$ is equal to one quarter of the wave length for the first frequency noise component of 219 Hz. The distance $D_2$ is equal to one quarter of the wave length for the second frequency noise component of 146 Hz. The attenuating means 30 is located at a relative minimum for the first frequency noise component. As a result, the first frequency sets up a standing wave and the second frequency noise is unaffected by attenuating means 30. As a result of the location of attenuating means 30, the first frequency wave which is at a relative minimum when it reaches means 30, reflects off the attenuating means toward end 24. The reflected first frequency wave is delayed out of phase by one-half of the first frequency wave thereby substantially canceling the first frequency wave propagating toward the attenuating means 30. The wave cancellation occurs approximately at end 24.

The second frequency wave is at a relative maximum as it reaches the attenuating means 30, and bypasses or is otherwise unaffected by attenuating means and propagates toward end cap 28. The second frequency wave is at a nodal point when it reaches endcap 28 and as a result the second frequency noise is reflected off the end cap back toward end 24 one half wave out of phase and as a result substantially cancels with the second frequency noise component wave propagating toward the end cap 28. Like the cancellation associated with first frequency wave, second frequency wave cancellation again occurs at approximately the end 24 of resonator 14. Although cancellation of two frequency waves is disclosed, it should be understood that any number of frequency waves may be canceled by multiple attenuating means in resonator branch of resonator 10.

The present invention resonator greatly reduces the noise emitted by a mobile temperature control unit. The present invention resonator offers a compact design to meet the space limitations in conventional temperature control systems, and cancels noise components of at least two frequencies in a single resonator branch without utilizing complicated valves or flappers or multiple resonator branches utilized in current resonators.

While we have illustrated and described a preferred embodiment of our invention, it is understood that this is capable of modification, and we therefore do not wish to be limited to the precise details set forth, but desire to avail ourselves of such changes and alterations as fall within the purview of the following claims.

Having described the invention, what is claimed is:

1. A side branch resonator for attenuating sound waves at first and second frequencies, the resonator comprising a resonator body having a first branch with an open end; and a second branch defining a second branch interior, the second branch having a closed end; the side branch resonator further comprising attenuating means for attenuating sound waves at a first frequency, the attenuating means located in the second branch interior away from the closed end, the closed end adapted to attenuate sound waves at a second frequency, the resonator further comprising a third branch with an axis and wherein a first distance is defined between the axis and the attenuating means, the first distance being equal to one quarter the wavelength of the first frequency sound waves.

2. The dual frequency side branch resonator as claimed in claim 1 wherein the resonator body is unitary.

3. The dual frequency side branch resonator as claimed in claim 1 wherein the attenuating means is comprised of a disk with an opening that permits sound waves at the second frequency to pass therethrough.

4. The dual frequency side branch resonator as claimed in claim 3 wherein the opening is circular.

5. The dual frequency side branch resonator as claimed in claim 1 further comprising a third branch with an axis and wherein a second distance is defined between the axis and the closed end, the second distance being equal to one quarter the wavelength of the second frequency sound waves.

6. The dual frequency side branch resonator as claimed in claim 1 wherein the first and second frequency sound waves each have maximum and minimum points, the attenuating means being located in the interior at the maximum point for the second frequency sound waves and at a minimum point for the first frequency sound waves.

7. The dual frequency side branch resonator as claimed in claim 1 wherein the second branch includes an elbow portion.

8. The dual frequency side branch resonator as claimed in claim 1 wherein the attenuating portion of the second branch is oriented perpendicular to the first branch.

9. The dual frequency side branch resonator as claimed in claim 1 wherein a third branch is made integral with the resonator body where the first and second branches are flow connected.

10. The dual frequency side branch resonator as claimed in claim 9 including an air filter means flow connected to the third branch.

11. The side branch resonator as claimed in claim 1 wherein the first frequency is equal to approximately 219 Hz.

12. A side branch resonator for attenuating sound waves of at least two frequencies, the side branch resonator comprising: a first resonator branch; a second resonator branch; an inlet branch flow connected to the first resonator branch, the inlet branch having an axis, the second resonator branch having a wall which defines a second resonator branch interior; said second resonator branch having an open second branch end and a closed second branch end; the resonator further comprising means for attenuating a sound wave of a first frequency, said means having an opening whereby sound waves at the second frequency travel through the attenuating means, the attenuating means being located in the second resonator branch interior a first distance from the axis and upstream from the closed second branch closed end wherein the first distance from the axis is equal to one quarter of the wavelength of the first frequency sound wave; said closed second branch end being located a second distance from the axis to provide attenuation of the second frequency sound waves.

13. The dual frequency side branch resonator as claimed in claim 12 wherein the second distance from the axis is equal to one quarter of the wavelength of the second frequency sound wave.

14. The side branch resonator as claimed in claim 12 wherein the attenuating means is a disk with a central aperture.

15. The dual frequency side branch resonator as claimed in claim 12 wherein the resonator is unitary.

16. A unitary side branch resonator for attenuating sound waves of at least two frequencies, the side branch resonator comprising a first resonator branch having a first resonator branch open end; a second resonator branch having a second resonator branch open end and a second resonator branch closed end, a bend portion offsetting the second and first branches by ninety degrees; a third branch having an axis; the second resonator branch having a wall which defines a second resonator branch interior, said second resonator branch having attenuating means for attenuating sound waves of a first frequency, said means located in the second resonator branch interior a distance from the axis equal to one quarter the wavelength of the first sound waves; said closed end being located a distance away from the axis equal to one quarter of the wavelength of the second sound waves; the side branch resonator also comprising an inlet flow connected to the first resonator branch proximate the first resonator branch end.

17. The side branch resonator as claimed in claim 16 wherein the attenuating means is a disk with an aperture provided in the disk.

18. The side branch resonator as claimed in claim 17 wherein the aperture is circular and is centrally located on the disk.

19. The side branch resonator as claimed in claim 17 wherein the second frequency is 145 Hz.

* * * * *